US008781354B2

(12) United States Patent
Iikura

(10) Patent No.: US 8,781,354 B2
(45) Date of Patent: Jul. 15, 2014

(54) IMAGE-FORMING APPARATUS

(75) Inventor: Kazuaki Iikura, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 174 days.

(21) Appl. No.: 12/868,395

(22) Filed: Aug. 25, 2010

(65) Prior Publication Data

US 2011/0206405 A1 Aug. 25, 2011

(30) Foreign Application Priority Data

Feb. 25, 2010 (JP) ..... 2010-040949

(51) Int. Cl.
*G03G 15/00* (2006.01)

(52) U.S. Cl.
USPC ..... 399/90

(58) Field of Classification Search
USPC ..... 399/90
See application file for complete search history.

(56) References Cited

U.S. PATENT DOCUMENTS

| | | | | |
|---|---|---|---|---|
| 6,081,676 | A | 6/2000 | Inomata | |
| 6,229,970 | B1 * | 5/2001 | Onimura et al. | 399/50 |
| 2005/0191080 | A1 | 9/2005 | Oguma et al. | |
| 2006/0193653 | A1 * | 8/2006 | Oguma et al. | 399/90 |
| 2009/0269097 | A1 | 10/2009 | Hashimoto | |

FOREIGN PATENT DOCUMENTS

| | | | |
|---|---|---|---|
| CN | 1661485 | A | 8/2005 |
| JP | H-11-52820 | | 2/1999 |
| JP | 11-102754 | | 4/1999 |
| JP | 11-194682 | A | 7/1999 |
| JP | 2002-072826 | A | 3/2002 |
| JP | 2004-138775 | A | 5/2004 |
| JP | 2005-100906 | A | 4/2005 |
| JP | 2009-265252 | A | 11/2009 |

OTHER PUBLICATIONS

Notice of Reasons for Rejection issued by the Japanese Patent Office in Japanese Patent Application No. 2010-040949 dated Nov. 12, 2013.

First Notification of Office Action issued by the State Intellectual Property Office of China in Patent Application No. 201010517438.9 dated Mar. 27, 2014.

* cited by examiner

*Primary Examiner* — Walter L Lindsay, Jr.
*Assistant Examiner* — Barnabas Fekete
(74) *Attorney, Agent, or Firm* — Sughrue Mion, PLLC

(57) ABSTRACT

An image-forming apparatus includes: an apparatus main body; a unit part that includes an electronic component and that can be installed in the apparatus main body by being guided in a first predetermined direction; a unit-side electrode that is provided to the unit part to be connected electrically with the electronic component; a main body-side electrode that is provided to the apparatus main body and is connected electrically with the unit-side electrode when the unit part is installed in the apparatus main body; and a ground electrode that is provided to the apparatus main body and is connected electrically with a ground, the ground electrode being disposed at a position upstream of the main body-side electrode with respect to the first predetermined direction.

20 Claims, 9 Drawing Sheets

IMAGE-FORMING APPARATUS

CROSS-REFERENCE TO RELATED APPLICATIONS

This application is based on and claims priority under 35 U.S.C. 119 from Japanese Patent Application No. 2010-40949, which was filed on Feb. 25, 2010.

BACKGROUND

1. Technical Field

The present invention relates to an image-forming apparatus.

2. Related Art

Generally in the art, image-forming apparatuses are formed of a main body having removable unit parts. Such unit parts may include, for example, a toner cartridge, a processing cartridge, and the like; and may contain electronic components, such as a memory for storing information indicating a state of use of a unit part.

SUMMARY

In one aspect of the present invention, there is provided an image-forming apparatus including: an apparatus main body; a unit part that includes an electronic component and that can be installed in the apparatus main body by being guided in a first predetermined direction; a unit-side electrode that is provided to the unit part to be connected electrically with the electronic component; a main body-side electrode that is provided to the apparatus main body and is connected electrically with the unit-side electrode when the unit part is installed in the apparatus main body; and a ground electrode that is provided to the apparatus main body and is connected electrically with a ground, the ground electrode being disposed at a position upstream of the main body-side electrode with respect to the first predetermined direction.

BRIEF DESCRIPTION OF THE DRAWINGS

Exemplary embodiments of the present invention will now be described in detail with reference to the following figures, wherein.

DETAILED DESCRIPTION

<1. Exemplary Embodiment>

Figure 1:
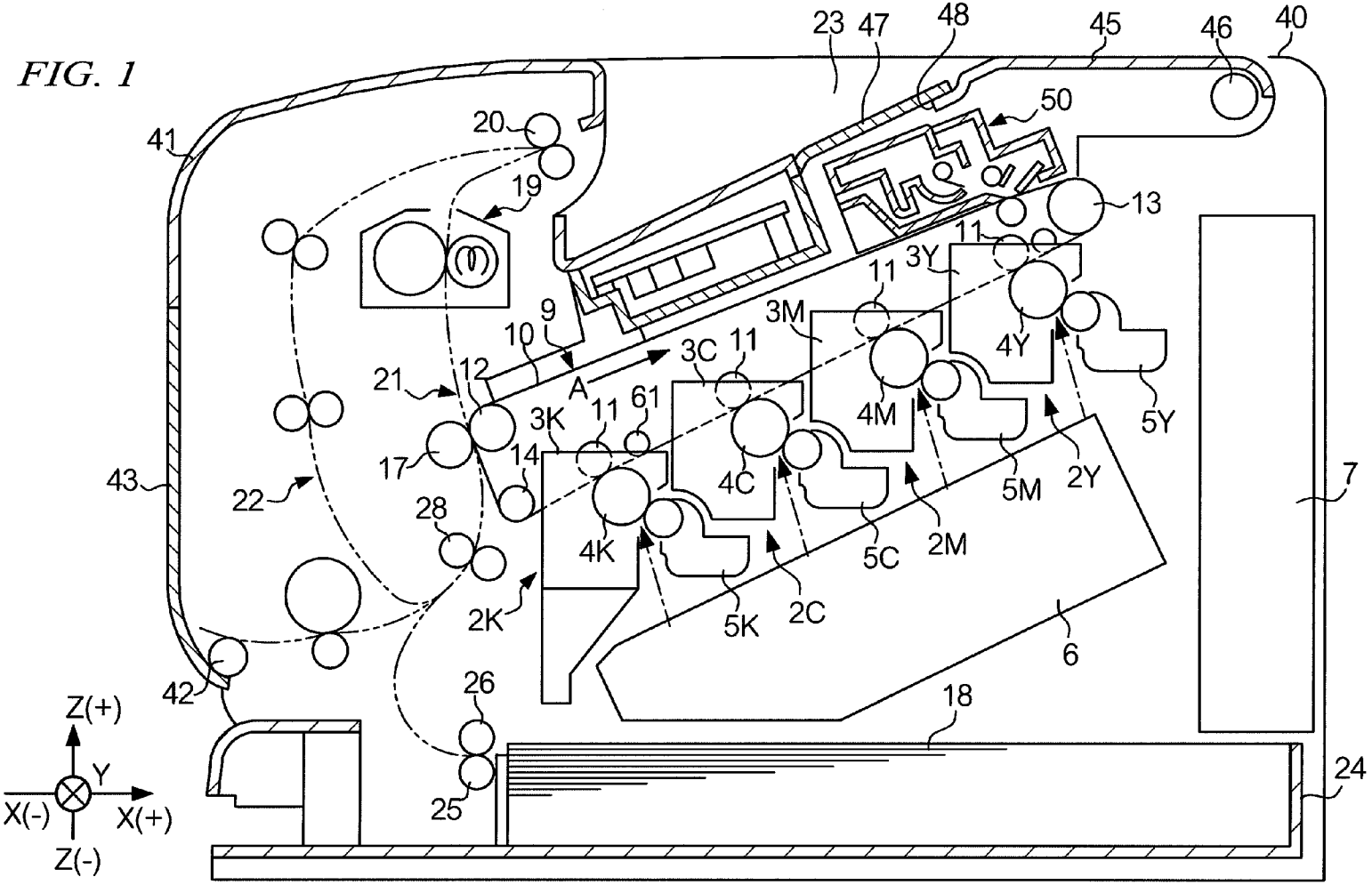
FIG. 1 schematically shows a configuration of an image-forming apparatus according to an exemplary embodiment of the present invention.

In the following, explanation will be given of an exemplary embodiment of the present invention, with an image-forming apparatus, such as a printer, a copy machine, or a facsimile, being taken as an example. FIG. 1 schematically shows a configuration of an image-forming apparatus according to the exemplary embodiment. In the following, description is given of image-forming apparatus 1 as viewed from the front of the apparatus, where the horizontal direction is denoted as the X-axis direction, with right/left directions from a viewer's perspective being indicated by X(+) and X(−), respectively; the front-back direction of image-forming apparatus 1 is denoted as the Y-axis direction, with back/front directions of image-forming apparatus 1 being indicated by Y(+) and Y(−), respectively; and the vertical direction is denoted as the Z-axis direction, with up/down directions being indicated by Z(+) and Z(−), respectively.

<Configuration of Image-Forming Apparatus>

Image-forming apparatus 1 is a color printer of a tandem type, in which image-forming units are arranged in a line along an intermediate transfer belt. Image-forming apparatus 1 contains an image-processing unit (not shown) that performs image processing on image data received from a device such as a scanner or a personal computer (not shown), or received via a telecommunications line (not shown), etc. Further, inside image-forming apparatus 1 there are provided four image-forming units 2Y, 2M, 2C, 2K for yellow (Y), magenta (M), cyan (C), and black (K), respectively. These image-forming units 2Y, 2M, 2C, 2K are arranged such that they are spaced apart from one another in a generally horizontal direction and extend parallel to one another in the Y-axis direction. In this configuration, vertical positions of image-forming units 2Y, 2M, 2C, 2K are lower respective to one another in the order stated. Accordingly, image-forming unit 2Y, which performs image transfer onto the intermediate transfer belt first, is positioned higher than image-forming unit 2K, which performs image transfer onto the intermediate transfer belt last, whereby a plane along which image-forming units 2Y, 2M, 2C, 2K are arranged is caused to incline at a predetermined angle (e.g., 20 degrees) relative to the horizontal direction. By this arrangement, a length of image-forming apparatus 1 in the horizontal direction (X-axis direction) can be reduced compared to a case where image-forming units 2Y, 2M, 2C, 2K each are arranged at a same height along the horizontal direction.

Each of the four image-forming units 2Y, 2M, 2C, 2K essentially has the same structure, and thus, in the following description, where it is not necessary to distinguish between image-forming units 2Y, 2M, 2C, 2K, the image-forming units will simply be referred to as image-forming unit(s) 2 collectively.

Each image-forming unit 2 has photosensitive member unit 3 and developer unit 5. Photosensitive member unit 3 includes photosensitive drum 4, which serves as an image-holding member, and a charging device. Photosensitive member unit 3 is a unit part, which is an assembly of components that can be installed in and removed from apparatus main body 40. Developer unit 5 is secured to apparatus main body 40 via a frame (not shown) to constitute a unit containment portion, in which photosensitive member unit 3 is installed.

Below image-forming units 2Y, 2M, 2C, 2K, image exposure unit 6, which is common to image-forming units 2Y, 2M, 2C, 2K, is provided. Image exposure unit 6 has four semiconductor laser units (not shown) for emitting laser beams modulated in accordance with image data of respective colors (Y, M, C, K). The four laser beams emitted from these semiconductor laser units are deflected by a polygon mirror and, via optical elements such as a lens and a mirror (not shown), are scanned over a surface of photosensitive drum 4 of corresponding image-forming unit 2Y, 2M, 2C, 2K to form an electrostatic latent image. The electrostatic latent images formed on photosensitive drums 4 are developed by developer units 5Y, 5M, 5C, 5K using developers each including a respective color toner, to form toner images of respective colors. The toner images of respective colors formed sequentially on photosensitive drums 4 of image-forming units 2Y, 2M, 2C, 2K are transferred one on top of another by primary transfer rollers 11 to an outer surface (or an underside surface) of intermediate transfer belt 10, which is arranged over the top of each of image-forming units 2Y, 2M, 2C, 2K, and serves as an intermediate transfer member.

Intermediate transfer belt 10 is an endless belt-shaped member tension-supported by multiple rollers, such as drive roller 12, tension roller 13, and idler roller 14, such that intermediate transfer belt 10 circulates in a direction indicated by arrow A under rotation of drive roller 12, which is rotated by a drive motor (not shown). Intermediate transfer belt 10 has an upper moving section and a lower moving section, and the lower moving section is inclined with respect to the horizontal direction, with a downstream end of the lower moving section positioned lower than an upstream end of the same with respect to the direction of movement of the lower moving section. Intermediate transfer belt 10 is arranged such that the lower moving section is in contact with photosensitive drums 4Y, 4M, 4C, 4K of image-forming units 2Y, 2M, 2C, 2K. As intermediate transfer belt 10, a flexible film made of a synthetic resin, such as polyimide, may be used, with ends of the synthetic resin film being joined by welding or the like so as to form an endless belt member.

It is to be noted that intermediate transfer belt 10, primary transfer rollers 11, drive roller 12, tension roller 13, idler roller 14, and others, constitute intermediate transfer unit 9.

Recording sheets 18, having a prescribed size and being made of a prescribed material, and serving as recording media, are contained in sheet container 24 disposed inside image-forming apparatus 1, and are conveyed from sheet container 24 along conveyance path 21 by multiple rollers. Recording sheets 18 are supplied from sheet container 24 one at a time by supply roller 25 and separation roller 26 for conveyance to registration rollers 28, where each sheet 18 is held temporarily. Registration rollers 28 are caused to rotate at a predetermined timing to further convey each recording sheet 18 to a secondary transfer position at intermediate transfer belt 10. At the secondary transfer position there is provided secondary transfer roller 17 on one side of intermediate transfer belt 10 and in opposing relation to drive roller 12 provided on the other side of intermediate transfer belt 10. Secondary transfer roller 17 is urged against intermediate transfer belt 10 to press each recording sheet 18 against intermediate transfer belt 10 as the sheet moves between secondary transfer roller 17 and intermediate transfer belt 10. Toner images of yellow (Y), magenta (M), cyan (C), and black (K) provided in overlapping relation on intermediate transfer belt 10 are transferred onto recording sheet 18 under pressure of secondary transfer roller 17 and action of electrostatic force. Fixing unit 19 applies heat and pressure to recording sheet 18 onto which toner images of respective colors have been transferred at the secondary transfer position, so as to fix the transferred images on recording sheet 18. Thereafter, recording sheet 18 is discharged by discharge roller 20 onto sheet-receiving tray 23, which is provided at an upper portion of image-forming apparatus 1. Conveyance path 21 also includes reversing mechanism 22 for reversing a front side and a back side of recording sheet 18.

Figure 2:
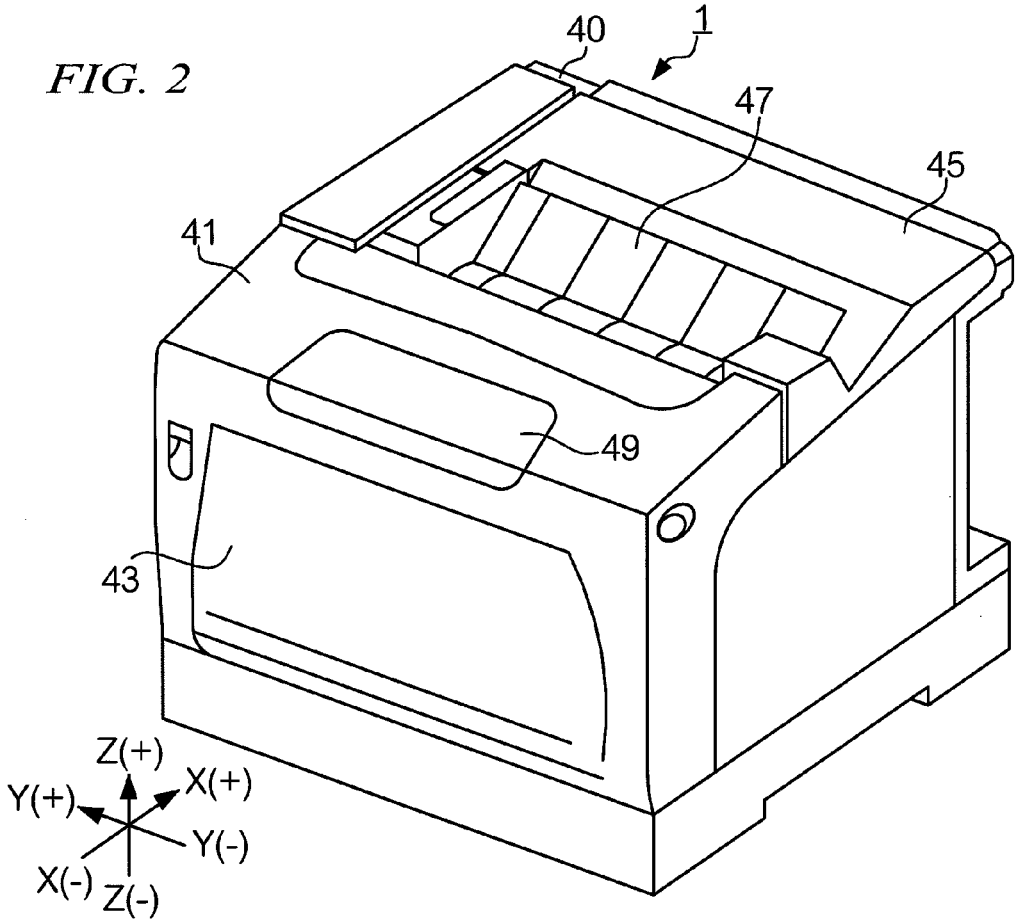
FIG. 2 is a perspective view showing an exterior of the image-forming apparatus.
Figure 3:
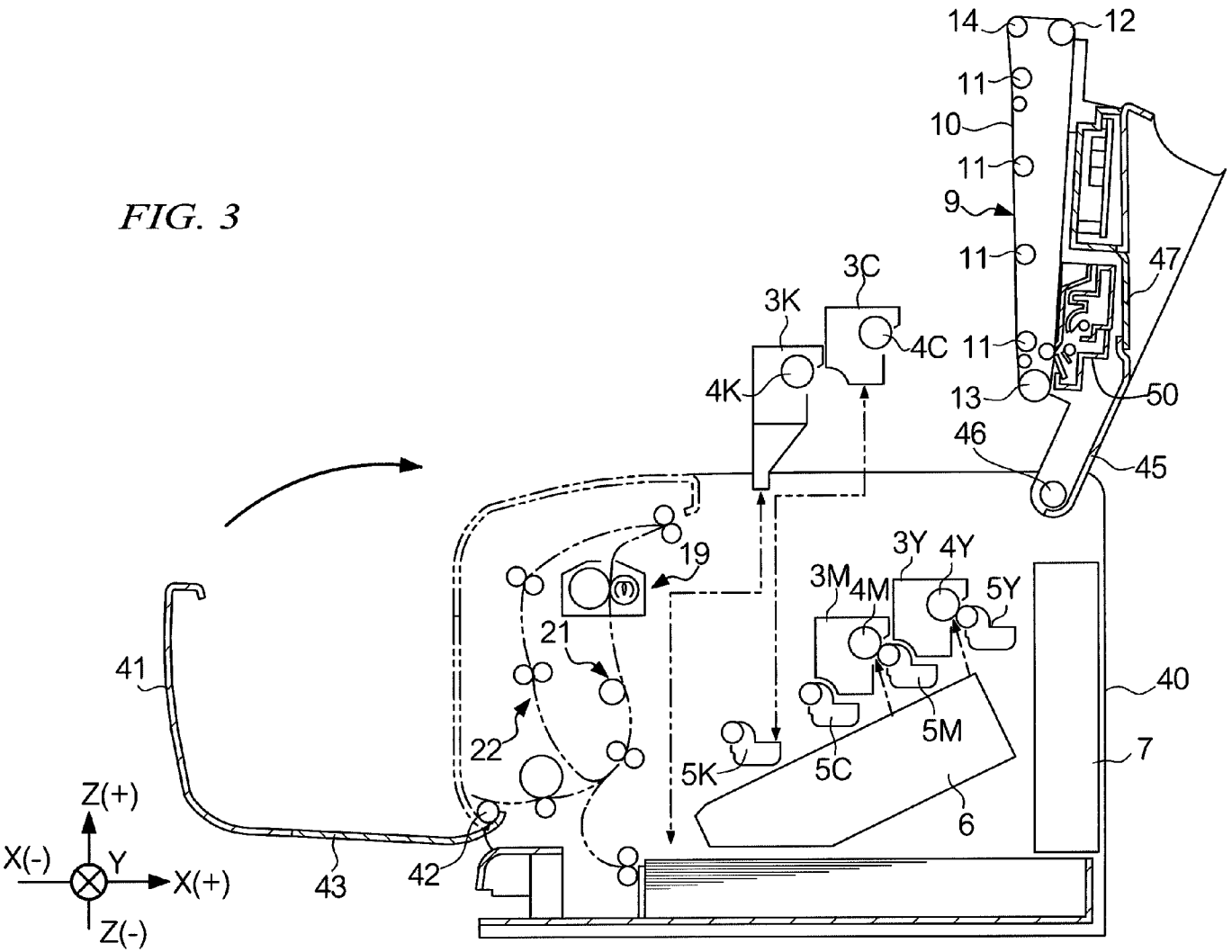
FIG. 3 is a cross-sectional view showing a state in which a lid member is opened.

In the following, further explanation will be given of a configuration of image-forming apparatus 1 with reference to FIGS. 2 and 3, in addition to FIG. 1. FIG. 2 is a perspective view showing an exterior of image-forming apparatus 1, and FIG. 3 is a diagram showing an inner configuration of image-forming apparatus 1 with a lid member in an open state.

On a lateral side of main body 40 of image-forming apparatus 1 is attached side cover 41, which is pivotable about support shaft 42 for opening and closing. Side cover 41 in turn is provided with manual sheet feed tray 43, which can be opened and closed relative to side cover 41. Manual sheet feed tray 43 is usually closed relative to side cover 41; but when it is desired to use a recording sheet of a type different from that contained in sheet container 24, manual sheet feed tray 43 is opened relative to side cover 41 so as to enable a desired recording sheet to be supplied to conveyance path 21 through the open manual sheet feed tray 43.

On an upper side of apparatus main body 40 there is provided lid member 45, which can pivot about support shaft 46 to be opened and closed. An upper surface of lid member 45 serves as sheet discharge tray 23, onto which recording sheets 18 having a toner image formed thereon are discharged. Further, operating unit 49 is provided on the upper side of apparatus main body 40. For example, operating unit 49 includes a ten-key pad for entering a number of recording sheets, and the like.

Generally, lid member 45 is kept closed relative to apparatus main body 40, and is opened when photosensitive member units 3Y, 3M, 3C, 3K are installed in or removed from apparatus main body 40. Prior to opening of lid member 45, side cover 41 is opened relative to apparatus main body 40, so that side cover 41 does not interfere with intermediate transfer unit 9 attached to an inner side of lid member 45. On the other hand, when side cover 41 is closed relative to apparatus main body 40, lid member 45 is closed relative to apparatus main body 40 before closing of side cover 41.

<Configuration of Photosensitive Member Unit>

Figure 4:
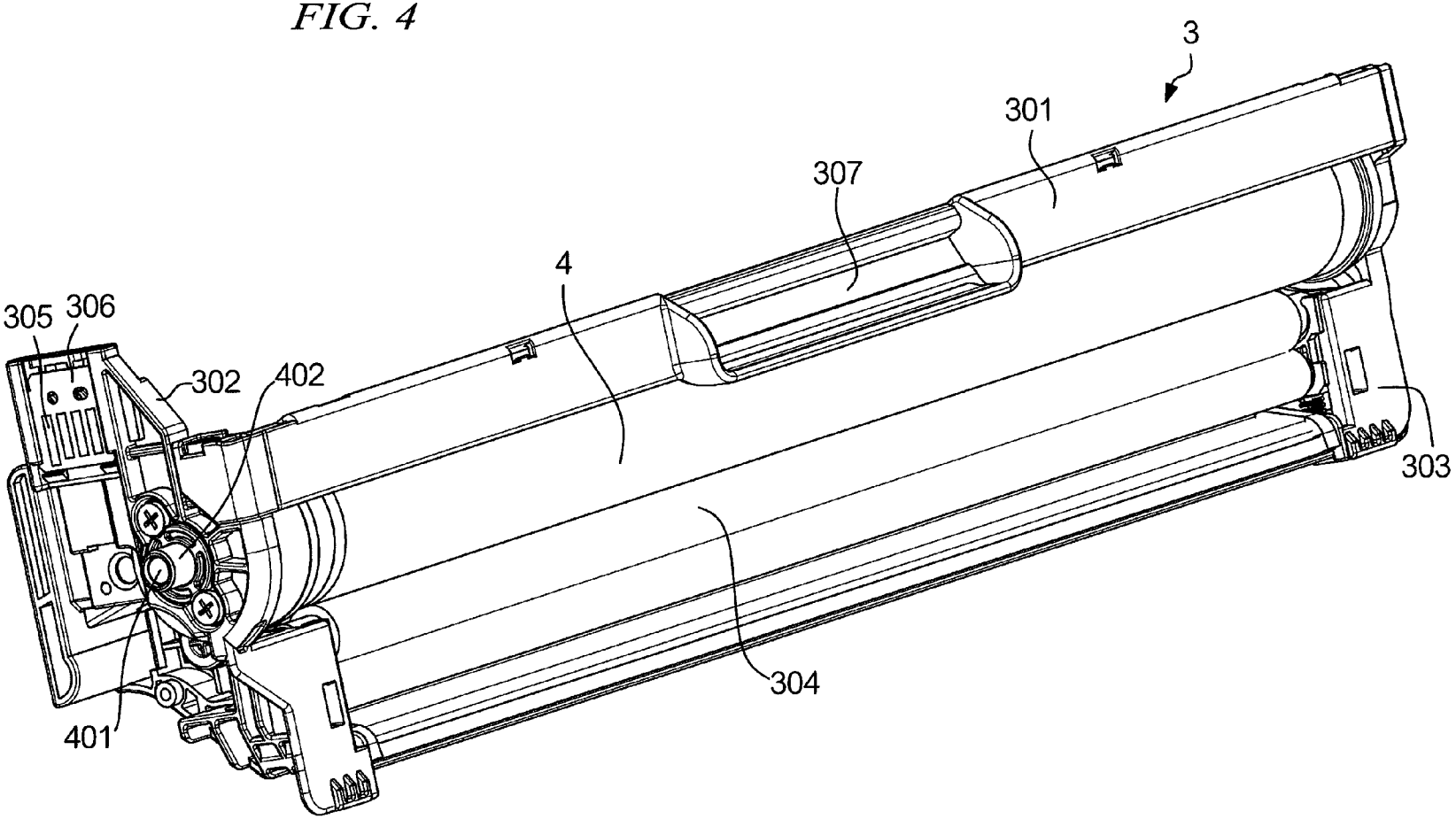
FIG. 4 is a perspective view showing a photosensitive member unit.

Next, with reference to FIG. 4, explanation will be given of a configuration of photosensitive member unit 3. FIG. 4 is a perspective view of photosensitive member unit 3.

Photosensitive member unit 3 has unit main body 301, which is made of a resin material and has an elongated shape, with flanges 302 and 303 being formed at respective longitudinal ends of unit main body 301. These flanges 302 and 303 rotatably support ends of photosensitive drum 4, charging roller 304, and so on. Photosensitive drum 4 has rotation shaft 401, each end of which is provided with slide bearing 402.

Further, circuit board 306, on which unit-side electrode 305 including four terminals is formed, is attached on an upper part of flange 302 with respect to a direction of gravity. To this circuit board 306 is mounted an electronic component having a memory function (not shown). This electronic component stores information indicating a state of use of photosensitive member unit 3 (e.g., a number of rotations and a rotating time period of photosensitive drum 4, or any malfunction that may have occurred thereto).

Also, in a middle part of unit main body 301 in a longitudinal direction, there is formed a handle portion 307 having a concave shape so that a user/operator (hereinafter referred to as a user) can easily hold photosensitive member unit 3.

<Configuration of Guide Plate>

Figure 7:
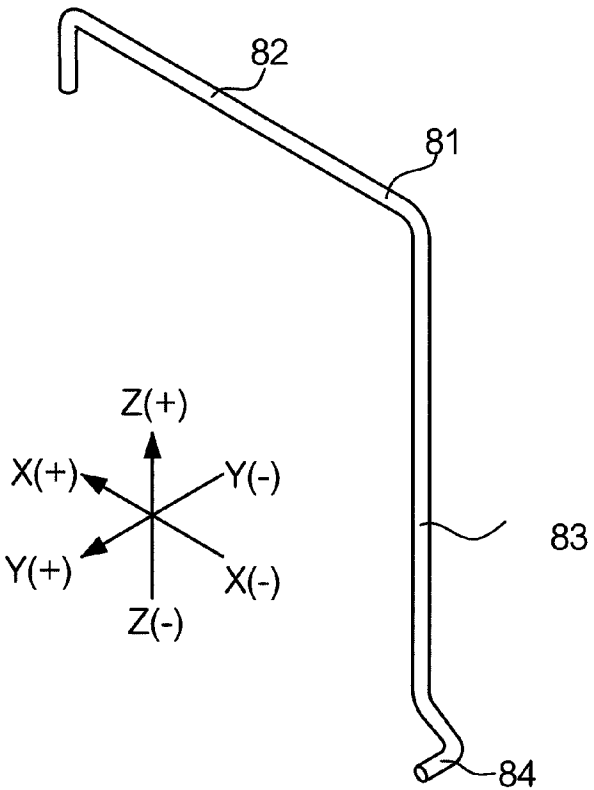
FIG. 7 is a perspective view showing a wire-shaped member that constitutes a ground electrode.
Figure 5:
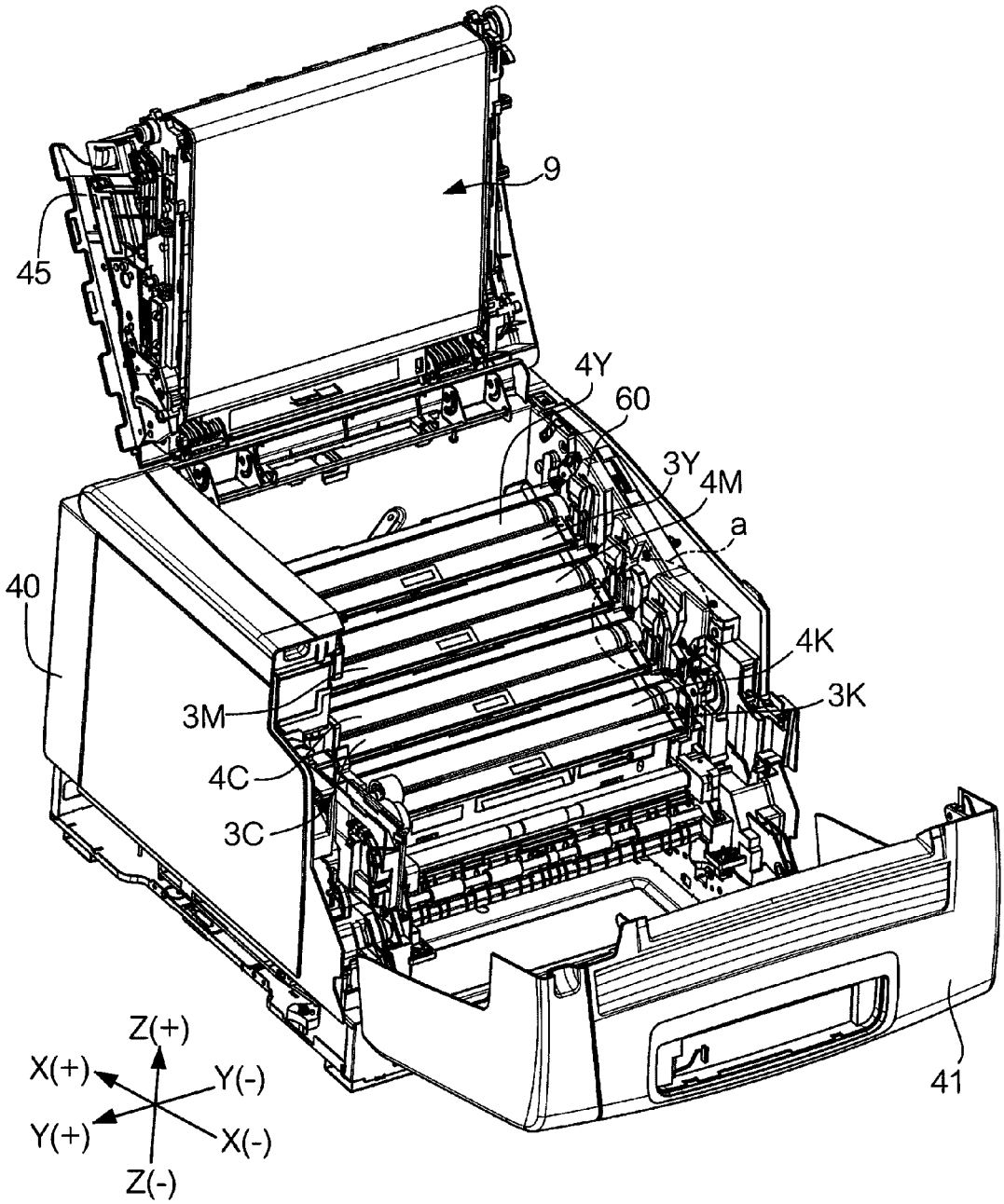
FIG. 5 is a perspective view showing a state in which a lid member and a side cover are opened.
Figure 6:
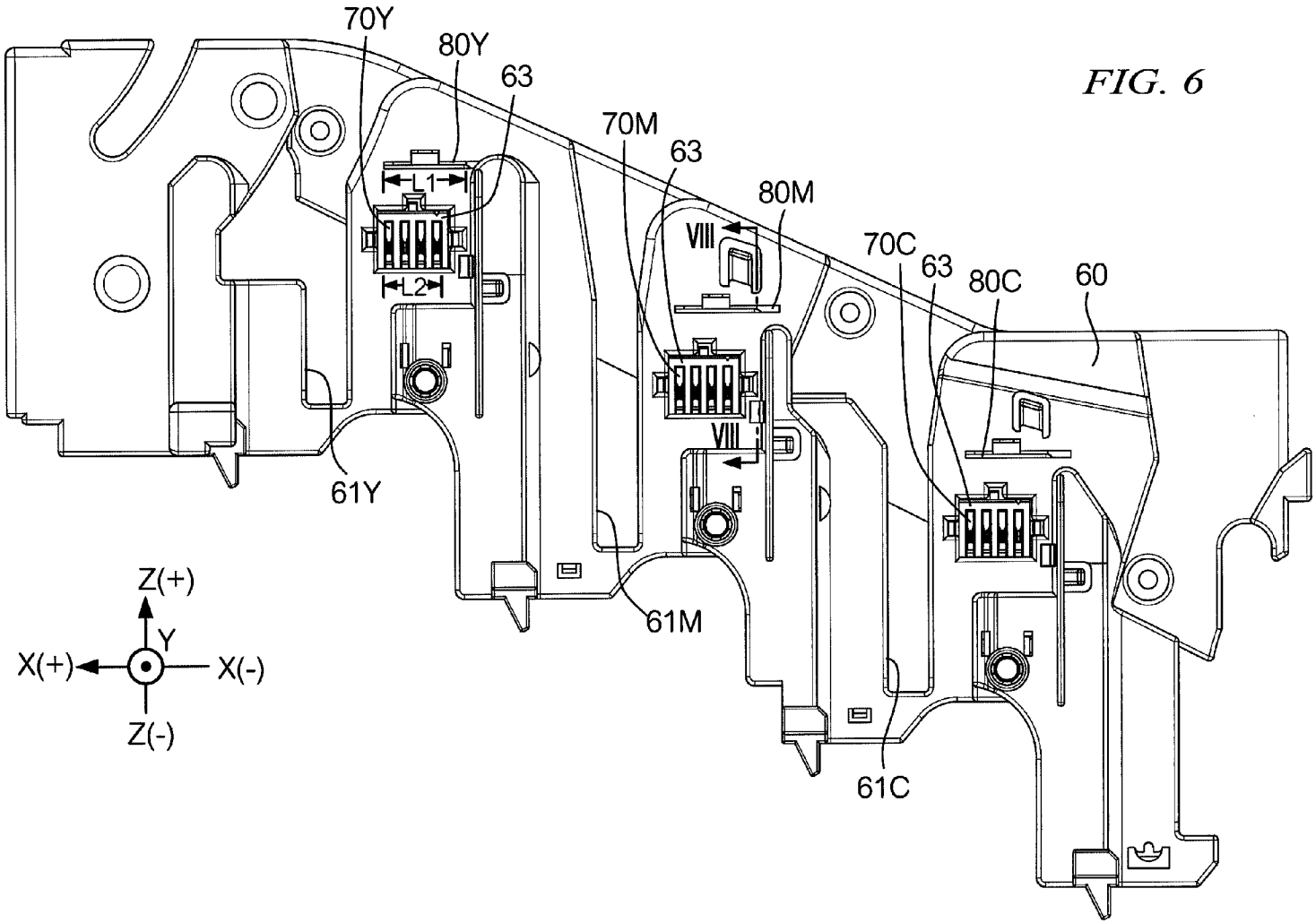
FIG. 6 is a plan view showing an inner side of a guide plate.
Figure 8:
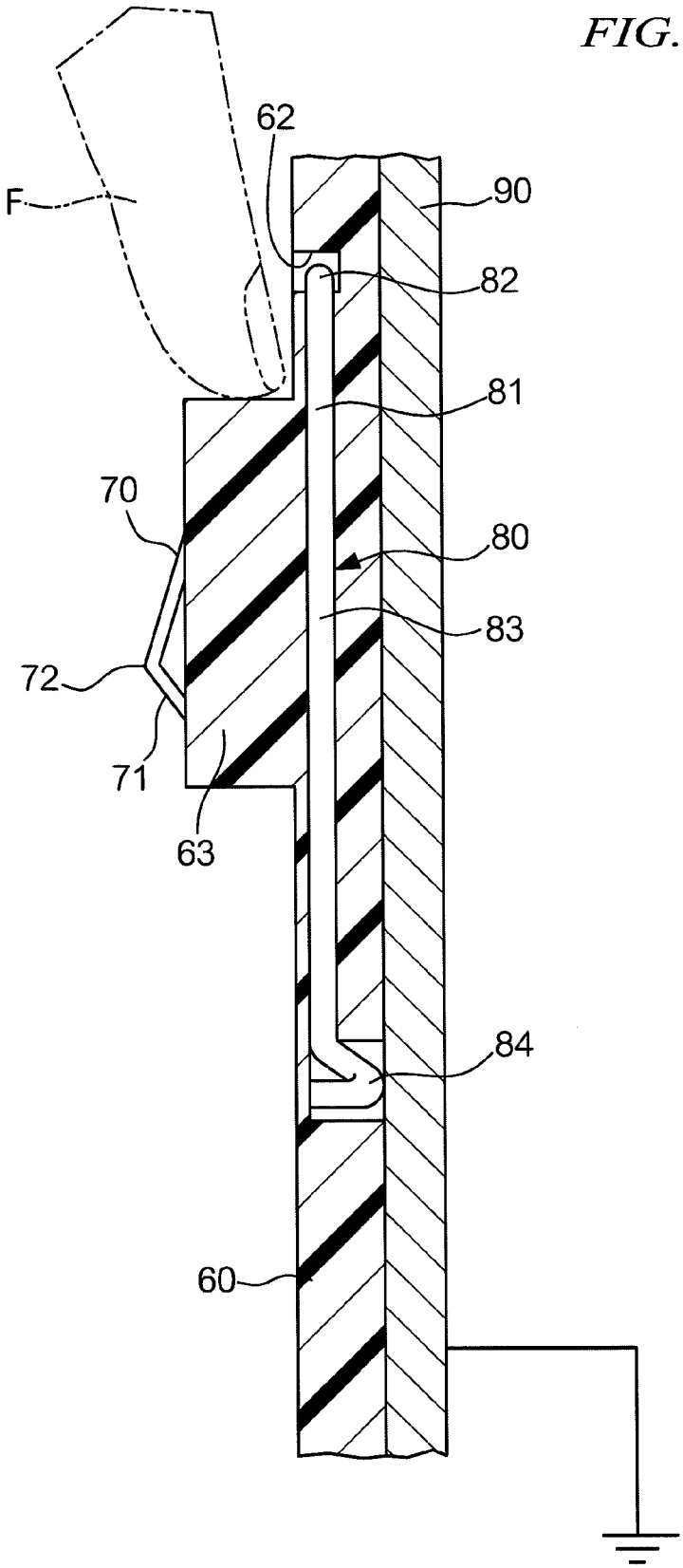
FIG. 8 is a cross-sectional view taken along line VIII-VIII in FIG. 6.
Figure 9:
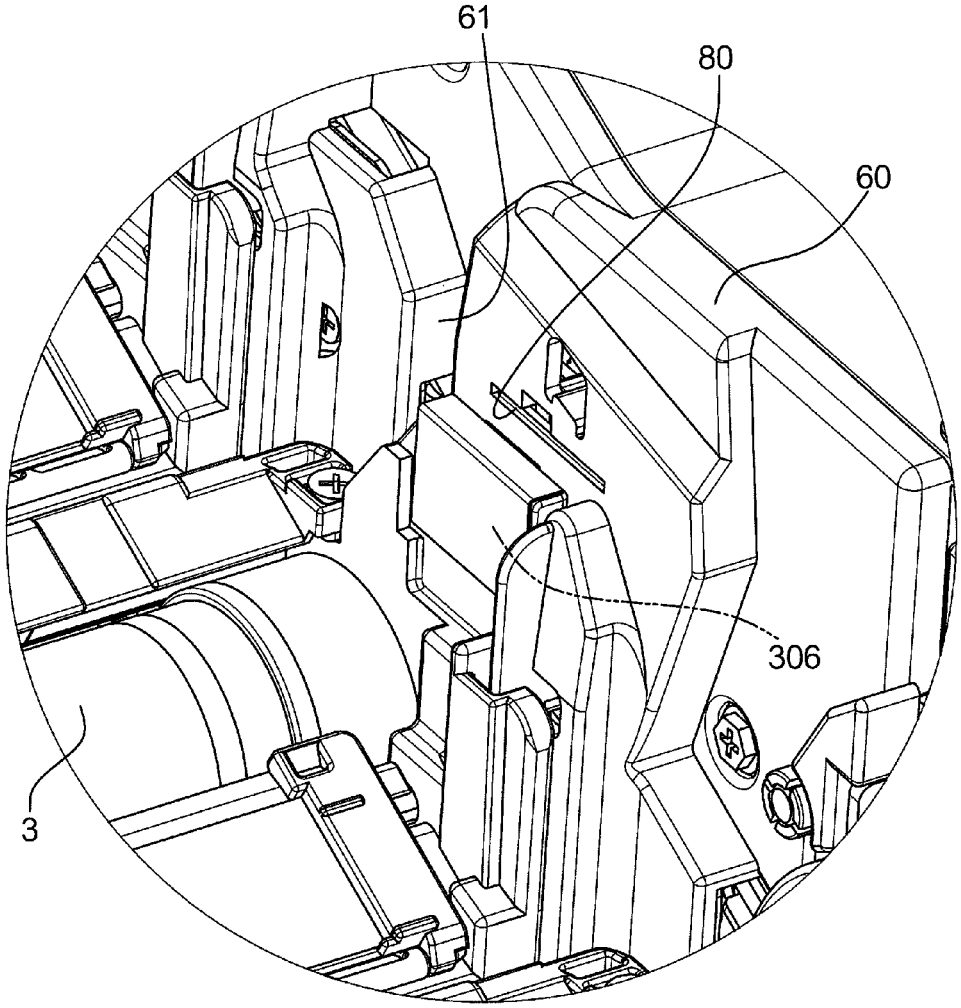
FIG. 9 is an enlarged view of part "a" in FIG. 5.
Figure 10:
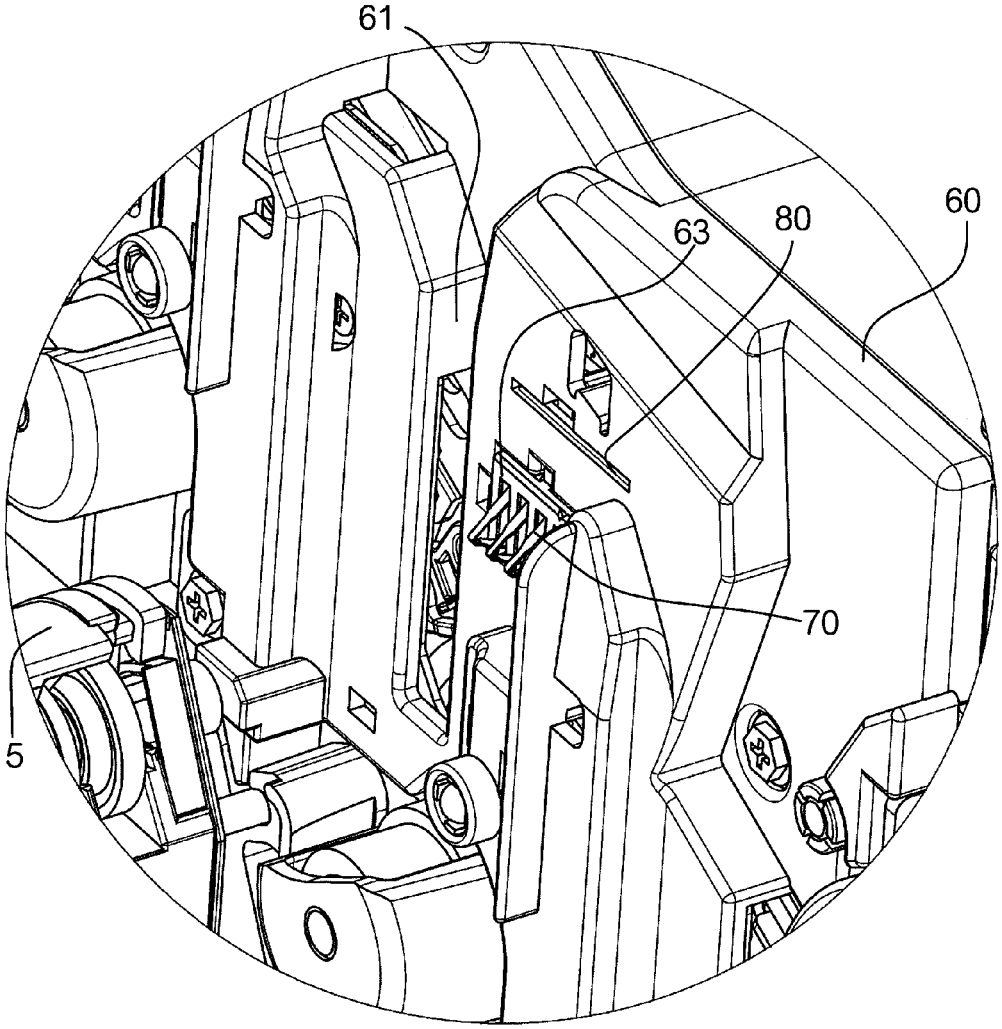
FIG. 10 is a perspective view from the same vantage point as FIG. 9 and shows a state in which a photosensitive member unit has been removed.

Next, explanation will be given of a guide plate, which is used when photosensitive member unit 3 is installed in or removed from apparatus main body 40. FIG. 5 is a perspective view showing a state in which lid member 45 and side cover 41 are opened. FIG. 6 is a plan view showing an inner side of a guide plate. FIG. 7 is a perspective view showing a wire-shaped member that constitutes a ground electrode. FIG. 8 is a cross-sectional view taken along line VIII-VIII in FIG. 6. FIG. 9 is an enlarged view of part "a" in FIG. 5. FIG. 10 is a perspective view from the same vantage point as FIG. 9 and shows a state in which photosensitive member unit 3 has been removed.

It is to be noted that a guide plate is provided on each of a front side (Y(−) side) and a back side (Y(+) side) of apparatus main body 40. In the following description, explanation is made with reference to the figures of the guide plate provided on the front side of apparatus main body 40.

Guide plate 60 is made of a resin material and has guide grooves 61Y, 61M, and 61C for guiding rotation shaft 401 of respective photosensitive member units 3Y, 3M, and 3C in a predetermined direction (Z-axis direction). Each photosensitive member unit 3, which is inserted into apparatus main body 40 from above (Z(+)) relative to the direction of gravity while being guided by guide groove 61, is set in apparatus main body 40 so as to be in contact with corresponding developer unit 5. On an outwardly facing side of guide plate 60 there is provided support plate 90 (see FIG. 8), which supports rotation shaft 401 of photosensitive drum 4 of each photosensitive member unit 3. This support plate 90 is a metallic plate and is grounded electrically via a frame member of apparatus main body 40. In this way, each rotation shaft 401 is connected electrically with a ground.

Guide plate 60 is provided with main body-side electrodes 70Y, 70M, and 70C each including four terminals 71. As shown in FIG. 8, each terminal 71 is made of a plate member that is bent to form an elastic protruding part 72. In this way, when photosensitive member unit 3 is installed in apparatus main body 40, terminals of unit-side electrode 305 and terminals 71 of main body-side electrode 70 can contact each other without difficulty.

In an installed state of photosensitive member unit 3, the terminals of unit-side electrode 305 contact terminals 71 of main body-side electrode 70, whereby an electronic component provided on photosensitive member unit 3 is connected electrically with an electronic circuit provided to apparatus main body 40. The electronic component on photosensitive member unit 3 receives information relating to an operation of photosensitive member unit 3 from the electronic circuit of apparatus main body 40, and stores the information.

Further, guide plate 60 is provided with ground electrodes 80Y, 80M, and 80C at positions above (or on the Z(+) side of) main body-side electrodes 70Y, 70M, and 70C with respect to the direction of gravity, that is, at positions upstream of main body-side electrodes 70 with respect to the direction in which photosensitive member units 3 are guided into apparatus main body 40 (or the Z(−) direction).

As shown in FIG. 7, each ground electrode 80 is made by bending a wire-shaped member 81. Wire-shaped member 81 is bent so as to assume generally an L shape so that in an installed state, wire-shaped member 81 (ground electrode 80) has horizontal portion 82, which extends in the horizontal direction (X-axis direction), and vertical portion 83, which extends in the vertical direction (Z-axis direction). Ground electrode 80 further has bent portion 84, which is formed by bending of an end part of vertical portion 83 such that bent portion 84 extends in a direction toward an inside of apparatus main body 40 (Y(+) direction).

Guide plate 60 is formed with recess 62, in which horizontal portion 82 is disposed. As shown in FIG. 6, length L1 of horizontal portion 82 is greater than length L2 over which terminals 71 of main body-side electrode 70 are arranged, whereby horizontal portion 82 is located over terminals 71 to cover them. Most of horizontal portion 82 and vertical portion 83 of ground electrode 80 is exposed. On the other hand, bent portion 84 elastically contacts support plate 90. As a result, ground electrode 80 is connected electrically with a ground via support plate 90. Ground electrode 80 is not disposed on a surface of guide plate 60, and thus, when photosensitive member body 3 is installed in or removed from apparatus main body 40, interference of ground electrode 80 with photosensitive member body 3 is prevented.

Guide plate 60 has electrode mounts 63, on which main body-side electrodes 70 are disposed. Each electrode mount 63 is raised from a surface of guide plate 60 to ensure that ground electrode 80 and main body-side electrode 70 are spaced apart from each other.

It should be noted that the guide plate on the back side (Y(+) side) is the same as guide plate 60 on the front side (Y(−) side) described in the foregoing, except that the guide plate on the back side is not provided with a main body-side electrode and a ground electrode, and thus, explanation on the guide plate on the back side is omitted.

According to recent trends, image-forming apparatus 1 having a smaller size is preferred. Thus, as shown in FIG. 1, toner-collecting unit 50 is disposed in an unused space defined on an inner side of lid member 45, for example, to decrease the size of apparatus main body 40.

On the other hand, taking into account that a user who carries out replacement of photosensitive member unit 3 may not be a trained operator, it is preferred that the main body-side terminals (or electrodes) and the unit-side terminals (or electrodes), via which an electronic circuit provided on apparatus main body 40 and an electronic component provided on photosensitive member unit 3 are connected electrically with each other, be provided at positions that cannot be seen easily when photosensitive member unit 3 is installed in or removed from apparatus main body 40. However, in apparatus main body 40 with a reduced size, it is difficult to dispose the electrodes at positions that cannot readily be seen by a user (i.e., in a lower part of apparatus main body 40) because the lower space is occupied by image exposure unit 6, developer units 5Y, 5M, 5C, and 5K, and power supply unit 7. Thus, in image-forming apparatus 1, main body-side electrodes 70 are arranged in an upper portion (Z(+)-side portion) of guide plate 60 with respect to the direction of gravity, as shown in FIG. 6, i.e., at positions that can readily be seen by a user when lid member 45 is opened. In accordance with such a position of main body-side electrodes 70, unit-side electrodes 305 on photosensitive member unit 3 need to be provided on an end surface of photosensitive member unit 3, as shown in FIG. 4.

Thus, in a case where a user replaces photosensitive member unit 3 with a new one, when the user opens lid member 45, main body-side electrodes 70 will be found right in front of the user, and the user may touch main body-side electrode 70. If a user touches main body-side electrode 70, static electricity accumulated on the clothes of the user may flow into an electronic circuit provided to apparatus main body 40 via main body-side electrode 70 to cause damage to electronic components constituting the electronic circuit, or static electricity may be stored temporarily in the electronic circuit and upon installment of photosensitive member unit 3 in main body 40, the static electricity can flow to photosensitive member unit 3 via electrodes 70 and 305 to cause problems such as damage to electronic components on photosensitive member unit 3.

To avoid such problems, in image-forming apparatus 1, ground electrode 80 is disposed to be closer to a user than main body-side electrode 70 when the user opens lid member 45. Ground electrode 80 is connected electrically with a ground via metallic support plate 90. In a case where a user happens to be almost touching main body-side electrode 70 inadvertently, a fingertip of the user will come close to ground electrode 80 before it comes close to main body-side electrode 70, and this causes electric discharge between the fingertip and ground electrode 80, thereby to cause static electricity to flow to the ground. After the discharge, if the user touches main body-side electrode 70, there is a low possibility that damage will be caused to electronic components.

It is considered that if a user holds handle portion 307 during work, problems as described in the foregoing are unlikely to occur. However, because replacement of photosensitive member unit 3 is often conducted by a user to solve a problem that occurs during printing or the like, the user conducting the replacement work may fail to read notices or the like such as those written on a packaging box of photosensitive member unit 3 for replacement, for example. Thus, the user may perform the replacement by holding the ends of photosensitive member unit 3 instead of holding handle portion 307, and in such a case, there is a high risk that the user's hand contacts main body-side electrode 70. However, in this case also, electric discharge is caused via ground electrode 80 before the user's hand contacts main body-side electrode 70, and thus, the electronic components can be protected.

Further, because horizontal portion 82 of ground electrode 80 is located over terminals 71 of main body-side electrode 70 to cover them, it is ensured that a fingertip of a user comes close to ground electrode 80 before it comes close to any of terminals 71, so that electric discharge due to static electricity is caused to take place between the fingertip and ground electrode 80.

It is also to be noted, relative to a distance between a fingertip of a user and electrodes 70 and 80, that, as shown in FIG. 8, when fingertip F of the user reaches electrode mount 63 during movement of fingertip F approaching electrodes 70 and 80, the distance between fingertip F and ground electrode 80 is smaller than the distance between fingertip F and main body-side electrode 70. Therefore, static electricity accumulated on the user causes electric discharge between fingertip F and ground electrode 80.

<2. Modified Embodiments>

The aforementioned exemplary embodiment may be modified as described in the following.

Ground electrode 80 does not have to be made of a wire-shaped member, and may have any shape, as long as it can cause static electricity accumulated on a user to be discharged before a hand (fingertip) of the user comes close to main body-side electrode 70.

Also, in the foregoing exemplary embodiment, ground electrode 80 is not disposed on a surface of guide plate 60, but ground electrode 80 may be disposed to protrude from the surface of guide plate 60. In such a case, a mechanism may be provided for allowing the protruding ground electrode 80 to flex easily or to retreat from the surface of guide plate 60 into a body of guide plate 60 when installment/removal of photosensitive member unit 3 is conducted.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

an apparatus main body;

a unit part that includes an electronic component and that can be installed in the apparatus main body by being guided in a first predetermined direction;

a unit-side electrode that is provided to the unit part to be connected electrically with the electronic component;

a main body-side electrode that is provided to the apparatus main body and is connected electrically with the unit-side electrode when the unit part is installed in the apparatus main body, wherein the main body-side electrode includes a terminal that protrudes in a direction perpendicular to the first predetermined direction;

a projecting part that is present adjacent to the main body-side electrode, wherein the projecting part is at least as long as the main-body side electrode in the first predetermined direction and extends beyond a top part of the main body-side electrode, and a width of the projecting part is larger than a width of the main body-side electrode in a direction perpendicular to the first predetermined direction; and a ground electrode that is provided to the apparatus main body and is connected electrically with a ground, wherein a width of the ground electrode is smaller than a width of the terminal in the direction perpendicular to the first predetermined direction, the ground electrode being disposed at a position upstream of the main body-side electrode with respect to the first predetermined direction.

2. The image-forming apparatus according to claim 1, wherein the main body-side electrode includes a plurality of terminals, and the ground electrode has a length greater than a total length of the plurality of terminals in a direction perpendicular to the first predetermined direction.

3. The image-forming apparatus according to claim 1, wherein the unit part includes an image-forming unit that forms an image, and the electronic component of the unit part is a memory that stores information indicating a state of use of the image-forming unit.

4. The image-forming apparatus according to claim 2, wherein the unit part includes an image-forming unit that forms an image, and the electronic component of the unit part is a memory that stores information indicating a state of use of the image-forming unit.

5. The image-forming apparatus according to claim 1, wherein the ground electrode is located at such a position that when a fingertip of a user approaches the main body-side electrode, a distance between the fingertip and the ground electrode is less than that between the fingertip and the main body-side electrode.

6. The image-forming apparatus according to claim 2, wherein the ground electrode is located at such a position that when a fingertip of a user approaches the main body-side electrode, a distance between the fingertip and the ground electrode is less than that between the fingertip and the main body-side electrode.

7. The image-forming apparatus according to claim 3, wherein the ground electrode is located at such a position that when a fingertip of a user approaches the main body-side electrode, a distance between the fingertip and the ground electrode is less than that between the fingertip and the main body-side electrode.

8. The image-forming apparatus according to claim 4, wherein the ground electrode is located at such a position that when a fingertip of a user approaches the main body-side electrode, a distance between the fingertip and the ground electrode is less than that between the fingertip and the main body-side electrode.

9. The image-forming apparatus according to claim 1, wherein the grounded electrode comprises a bent wire-shaped member.

10. The image-forming apparatus according to claim 9, wherein the bent wire-shaped member has an L-shape comprising a horizontal section, a vertical section and a bent section formed by bending an end part of the vertical section.

11. The image-forming apparatus according to claim 10, wherein the bent section extends in a direction toward an inside of the apparatus main body.

12. The image-forming apparatus according to claim 1, further comprising a developer unit in contact with the unit part.

13. The image-forming apparatus according to claim 1, wherein the projecting part engages with the unit part.

14. The image-forming apparatus according to claim 1, wherein the projecting part is longer than the main body-side electrode in the first predetermined direction.

15. The image-forming apparatus of claim 1, having a plurality of main body-side electrodes, a plurality of ground electrodes and a plurality of projecting parts, wherein each of the plurality of ground electrodes is disposed at a position upstream with respect to the first predetermined direction of a respective one of the plurality of main body-side electrodes, and each of the plurality of projecting parts is disposed adjacent to a respective one of the plurality of main body-side electrodes.

16. An image-forming apparatus comprising:

an apparatus main body;

a unit part that includes an electronic component and that can be installed in the apparatus main body by being guided in a first predetermined direction by the guiding plate;

a main body-side electrode that is provided on the apparatus main body to be connected electrically with the electronic component, wherein the main body-side electrode is provided on one surface of the guiding plate;

a unit-side electrode that is provided on the unit part and is connected electrically with the main body-side electrode when the unit part is installed in the apparatus main body; and a ground electrode that is provided on the apparatus main body and is connected electrically with a ground, being disposed at a position upstream of the main body-side electrode with respect to the first predetermined direction, wherein the ground electrode is present on a surface of the guiding plate opposite to the surface of the guiding plate on which the main body-side electrode is provided, and wherein the ground electrode comprises a bent wire-shaped member.

17. The image-forming apparatus according to claim 16, wherein the wire-shaped member is bent in an L-shape.

18. The image-forming apparatus according to claim 17, wherein the L-shape comprising a horizontal section, a vertical section and a bent section formed by bending an end part of the vertical section.

19. The image-forming apparatus according to claim 14, wherein the projecting part extends beyond a bottom part of the main body-side electrode.

20. The image-forming apparatus of claim 15, wherein the plurality of ground electrodes are connected electrically with a common grounding member.

* * * * *